US007798108B2

(12) United States Patent
Konishi et al.

(10) Patent No.: US 7,798,108 B2
(45) Date of Patent: Sep. 21, 2010

(54) WATER-JACKET STRUCTURE FOR WATER-COOLED INTERNAL COMBUSTION ENGINE

(75) Inventors: Yukio Konishi, Wako (JP); Hirosuke Niwa, Wako (JP); Junya Iino, Wako (JP); Takayuki Takatoku, Haga-Gun (JP); Makoto Ito, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 351 days.

(21) Appl. No.: 12/122,349

(22) Filed: May 16, 2008

(65) Prior Publication Data

US 2008/0283001 A1 Nov. 20, 2008

(30) Foreign Application Priority Data

May 16, 2007 (JP) ..... 2007-130011

(51) Int. Cl.
*F02F 1/14* (2006.01)
*F02F 1/10* (2006.01)

(52) U.S. Cl. ..... 123/41.79; 123/41.72; 123/41.82 R

(58) Field of Classification Search ..... 123/41.72, 123/41.74, 41.79, 41.75, 41.81, 41.82 R, 123/41.82 A, 41.58, 41.59, 41.83, 41.84, 123/193.1–493.6, 657, 668, 669, 671
See application file for complete search history.

(56) References Cited

U.S. PATENT DOCUMENTS 4,455,972 A * 6/1984 Kawakami ..... 123/41.74
4,470,376 A * 9/1984 Hayashi ..... 123/41.74
5,188,071 A * 2/1993 Han ..... 123/195 R
5,558,048 A * 9/1996 Suzuki et al. ..... 123/41.74
5,988,120 A * 11/1999 Betsch et al. ..... 123/41.74
6,481,392 B1 * 11/2002 Etemad ..... 123/41.74
6,581,550 B2 * 6/2003 Shinpo et al. ..... 123/41.74
6,834,625 B2 12/2004 Matsutani et al.

(Continued)

FOREIGN PATENT DOCUMENTS

FR 2879260 A1 6/2006

(Continued)

OTHER PUBLICATIONS

Japanese Office Action for Application No. 2007-130011, dated Apr. 28, 2009.

(Continued)

*Primary Examiner*—Michael Cuff
*Assistant Examiner*—Hung Q Nguyen
(74) *Attorney, Agent, or Firm*—Lahive & Cockfield, LLP; Anthony A. Laurentano

(57) ABSTRACT

A water-jacket structure, for a water-cooled internal combustion engine, forms a cylinder block water jacket in a cylinder block so as to surround cylinder bores formed in the cylinder block to make cooling water flow through the cylinder block water jacket into a cylinder head water jacket formed in a cylinder head joined to the cylinder block. An upper connecting opening is formed in an upper part of the cylinder block water jacket so as to open into the cylinder head water jacket. In the cylinder block is formed a lower connecting passage opening into a lower part of the cylinder block water jacket, extending upward, and connecting to the cylinder head water jacket.

5 Claims, 12 Drawing Sheets

U.S. PATENT DOCUMENTS

| | | | | |
|---|---|---|---|---|
| 6,874,451 | B2 * | 4/2005 | Matsutani et al. | 123/41.79 |
| 7,032,547 | B2 * | 4/2006 | Xin | 123/41.72 |
| 7,107,954 | B2 | 9/2006 | Yamashita et al. | |
| 7,216,611 | B2 * | 5/2007 | Matsutani et al. | 123/41.72 |
| 7,438,026 | B2 * | 10/2008 | Nakada et al. | 123/41.74 |

FOREIGN PATENT DOCUMENTS

| | | |
|---|---|---|
| JP | 55-41506 | 3/1980 |
| JP | 62-124217 | 8/1987 |
| JP | 1-34677 | 10/1989 |
| JP | 2002-013440 | 1/2002 |
| JP | 2002-266695 | 9/2002 |
| JP | 2006-105019 | 4/2006 |

OTHER PUBLICATIONS

Chinese Office Action for Application No. 2008100960640, dated Jan. 22, 2010.

* cited by examiner

WATER-JACKET STRUCTURE FOR WATER-COOLED INTERNAL COMBUSTION ENGINE

BACKGROUND OF THE INVENTION

1. Field of the Invention

The present invention relates to a water-jacket structure for a water-cooled internal combustion engine and, more specifically, to a water-jacket structure for a cylinder block.

2. Description of the Related Art

In an in-line multicylinder water-cooled internal combustion engine disclosed in, for example, Japanese Patent Application Publication No. 2006-105019, cooling water flows through a cooling water inlet formed in one of opposite ends of a cylinder block with respect to a direction in which cylinder bores are arranged, into a cylinder block water jacket surrounding the cylinder bores, and flows through the cylinder block water jacket to cool the cylinder block. Then, the cooling water flows upward through a connecting port formed in an upper part of the other end of the cylinder block into a cylinder head water jacket surrounding combustion chambers, and flows through the cylinder head water jacket to cool the cylinder head.

In a water-cooled internal combustion engine disclosed in Japanese Patent Application Publication No. 2002-13440, a spacer is placed in a cooling water outlet passage connecting to a cooling water outlet of a cylinder block water jacket to improve cooling efficiency by preventing the stagnation of the cooling water.

In the cylinder block water jacket of the water-cooled internal combustion engine disclosed in Japanese Patent Application Publication No. 2006-105019, the cooling water that has flowed into the cylinder block water jacket through the one end of the cylinder block flows in branch flows along side parts, on the opposite sides of the in-line cylinder bores, of the cylinder block water jacket, the branch flows of the cooling water meet at the opposite end of the cylinder block, and then the cooling water flows upward through the connecting port in the upper part of the other end of the cylinder block into the cylinder head water jacket.

The branch flows of the cooling water meet at the other end of the cylinder block water jacket, and the combined water flow leaves the cylinder block water jacket upward. The cooling water that has flowed through an upper part of the cylinder block water jacket also forms a combined upper flow. The cooling water that has flowed through a lower part of the cylinder block water jacket is obstructed by the combined upper flow and cannot smoothly flow upward and stagnates. Consequently, cooling efficiency drops.

In the water-cooled internal combustion engine disclosed in Japanese Patent Application Publication No. 2002-13440, the spacer is placed in the cylinder block water jacket to form a dam that guides the branch flows of the cooling water that has flowed through the side parts of the cylinder block water jacket so that the branch flows may not meet and may smoothly flow upward.

However, the spacer reduces the volume of a space in which the cooling water flows and hence cooling ability is lessened.

The present invention has been made in view of such problems and it is therefore an object of the present invention to provide a water-jacket structure for a water-cooled internal combustion engine, which does not use any member corresponding to the spacer and is capable of improving the cooling ability of the cooling system of the water-cooled internal combustion engine.

SUMMARY OF THE INVENTION

To attain the above object, the present invention provides a water-jacket structure for a water-cooled internal combustion engine, comprising: a cylinder block having at least one cylinder bore and a cylinder block water jacket surrounding the cylinder bore; and a cylinder head joined to an upper surface of the cylinder head and having a cylinder head water jacket, a cooling water passage being formed to cause cooling water to flow from the cylinder block water jacket into the cylinder head water jacket: wherein the water-jacket structure has an upper connecting opening which opens at an upper part of the cylinder block water jacket and connects to the cylinder head water jacket, and a lower connecting passage formed in the cylinder block and connected to a lower part of the cylinder block water jacket, said lower connecting passage extending upward from the lower part of the cylinder block water jacket and connecting to the cylinder head water jacket.

In the water-jacket structure of the present invention for the water-cooled internal combustion engine, the cylinder block is provided with the lower connecting passage opening at the lower part of the cylinder block water jacket, extending upward and connecting to the cylinder head water jacket in addition to the upper connecting opening. Therefore, the cooling water that has flowed through a lower part of the cylinder block water jacket, which is prevented from flowing upward and tends to stagnate by the flows of the cooling water in an upper part of the cylinder block water jacket of the known water-jacket structure, can smoothly flow upward through the lower connecting passage into the cylinder head water jacket, the volume of a space in which the cooling water flows in the cylinder block water jacket is not reduced by a spacer or the like, and hence the cooling ability of the cooling system can be improved.

In a preferred embodiment of the invention, the cylinder block is provided with a plurality of cylinder bores arranged in a row, a cooling water inlet to the cylinder block water jacket is formed in one of opposite ends with respect to a direction in which the cylinder bores are arranged, of the cylinder block, and the upper connecting opening and the lower connecting passage are formed in the other end of the cylinder block.

Since the cooling water inlet is formed in the one end, with respect to a direction in which the cylinder bores are arranged, of the cylinder block, and the upper connecting opening and the lower connecting passage are formed in the opposite end of the cylinder block, the cylinder bores can be uniformly cooled from the opposite sides thereof for efficient cooling.

In a preferred embodiment of the invention, an bulged space is formed in a direction along an axis of the cylinder bore on an outer wall defining the cylinder block water jacket by bulging out a part of the outer wall, and the lower connecting passage is formed in the bulged space by a partition member inserted in a direction along the axis of the cylinder bore into the bulged space.

When the bulged space is formed on the outer side wall by bulging out a part of the outer side wall defining the cylinder block water jacket, and the lower connecting passage is defined in the bulged space by the partition member inserted into the bulged space, the lower connecting passage can be easily formed without reducing the volume of the cylinder block water jacket and without adversely affecting cooling ability.

Preferably, the partition member is provided with an opening in a middle part thereof with respect to a direction along the axis of the cylinder bore.

The cooling water flowing through a middle part, at a middle height, of the cylinder block water jacket can flow through the opening of the partition member into the lower connecting passage and can smoothly flow upward through the lower connecting passage into the cylinder head water jacket without being caused to stagnate by the cooling water flowing through an upper part of the cylinder block water jacket to improve the cooling ability.

In the water-jacket structure according to the present invention for a water-cooled internal combustion engine, the partition member may be provided with protrusions in contact with an inner side wall defining the cylinder block water jacket.

The protrusions of the partition member in contact with the inner side wall defining the cylinder block water jacket facilitates positioning the partition member in the bulged space and can securely hold the partition member in place.

Preferably, the bulged space has a substantially rectangular cross section, the partition member has opposite, flange-like side parts, the flange-like side parts extend along inside surfaces of side walls defining the bulged space, and the flange-like side parts are in contact with inside surfaces of the bulged space.

Preferably, the partition member is provided with protrusions protruding in a direction opposite a direction in which the flange-like side parts extend, and in contact with the inner side wall defining the cylinder block water jacket.

Thus the partition member can be easily and surely positioned in the bulged space.

In a preferred form of the invention, the bulged space has a substantially rectangular cross section, the partition member has opposite, flange-like side parts, the flange-like side parts extend along inside surfaces of side walls defining the bulged space, and the flange-like side parts are in contact with inside surfaces of the bulged space.

Further, in a preferred form of the invention, the partition member is provided with protrusions protruding in a direction opposite a direction in which the flange-like side parts extend, and in contact with the inner side wall defining the cylinder block water jacket.

Thus the partition member can be positioned reliably in the bulged space.

A lower end part of the partition member may be seated on a step formed in a middle part of the bulged space.

Thus the partition member can be easily positioned with respect to a vertical direction.

Desirably, the surfaces of the partition member are coated with an elastic coating.

DESCRIPTION OF THE PREFERRED EMBODIMENTS

A water-jacket structure in a preferred embodiment of the present invention will be descried with reference to FIGS. 1 to 13.

Figure 1:
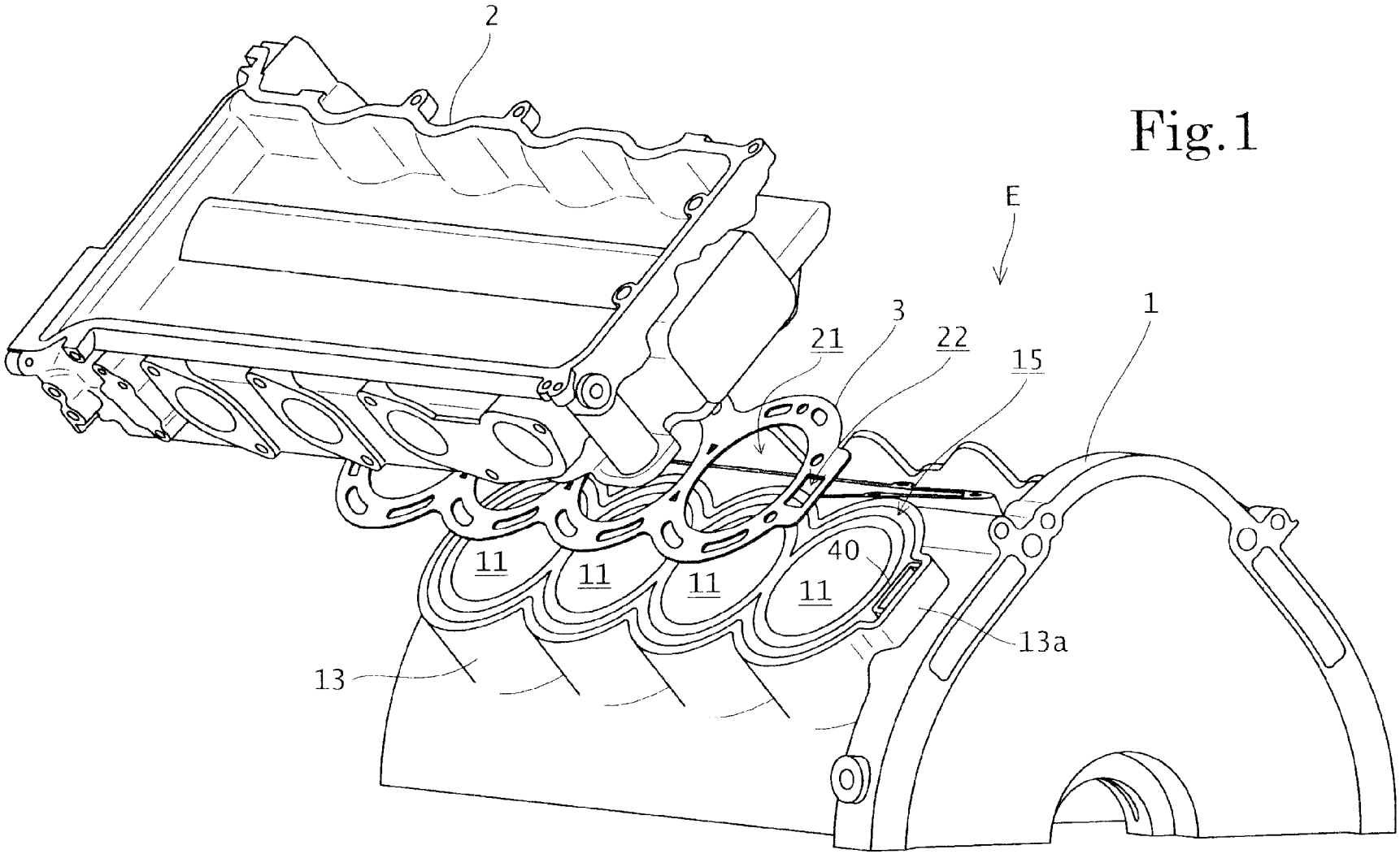
FIG. 1 is a fragmentary, exploded perspective view of an internal combustion engine including a water-jacket structure in a preferred embodiment of the present invention.

An internal combustion engine E to which the present invention is applied is a V-type 8-cylinder internal combustion engine having two banks having four cylinders each. As shown in FIG. 1, four cylinder bores 11 are arranged in a row in each bank in a cylinder block 1. A cylinder head 2 is fastened to the upper surface of the cylinder block 1 with a gasket 3 held between the cylinder block 1 and the cylinder head 2.

Figure 2:
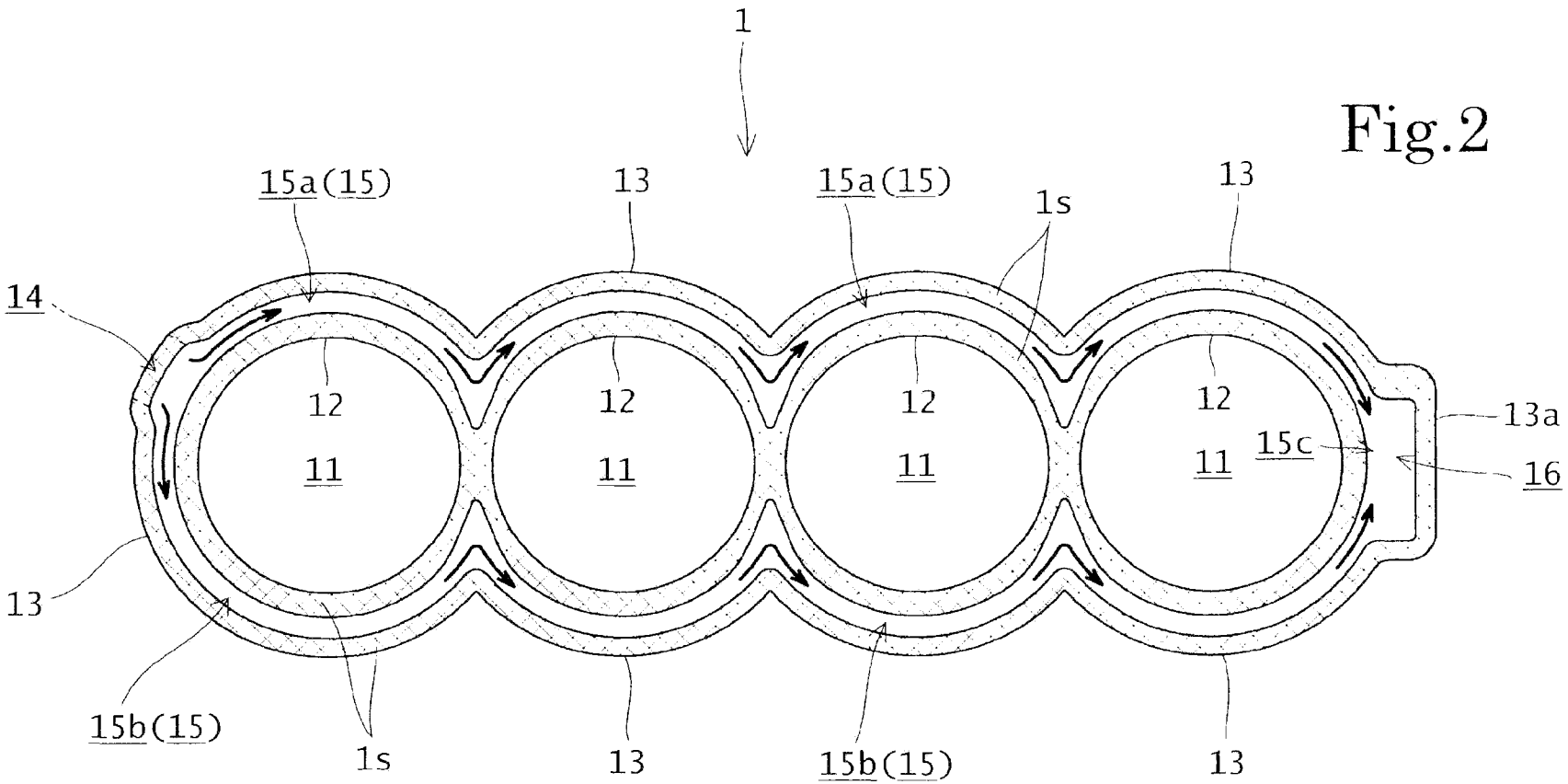
FIG. 2 is a top view of a cylinder block.

Referring to FIG. 2 showing the cylinder block 1 in a top view, the cylinder block 1 has an inner side wall 12 defining the cylinder bores 11, and an outer side wall 13 surrounding the inner side wall 12. A cylinder block water jacket 15 is defined by the inner side wall 12 and the outer side wall 13.

The cylinder block water jacket 15 has two side passages 15*a* and 15*b* on the opposite sides, respectively, of the row of the cylinder bores 11.

A cooling water inlet 14 is formed in one (a first end) of the opposite ends of the cylinder block 1 with respect to a direction in which the cylinder bores 11 are arranged. Cooling water flows through the cooling water inlet 14 into the cylinder block water jacket 15. The cooling water supplied through the cooling water inlet 14 into the cylinder block water jacket 15 is divided into two cooling water streams. The two cooling water streams flow through the two side passages 15*a* and 15B, respectively, toward the other or second end of the cylinder block 1.

A bulged part 13*a* bulging outward is formed in the other end of the outer side wall 13 of the cylinder block 1. The bulged part 13*a* and a part of the inner side wall 12 corresponding to the bulged part 13*a* define a bulged space 16. The two cooling water streams that have flowed through the two side passages 15*a* and 15*b* meet in the bulged space 16. As shown in FIG. 2, the bulged space 16 has a substantially rectangular cross section.

Figure 3:
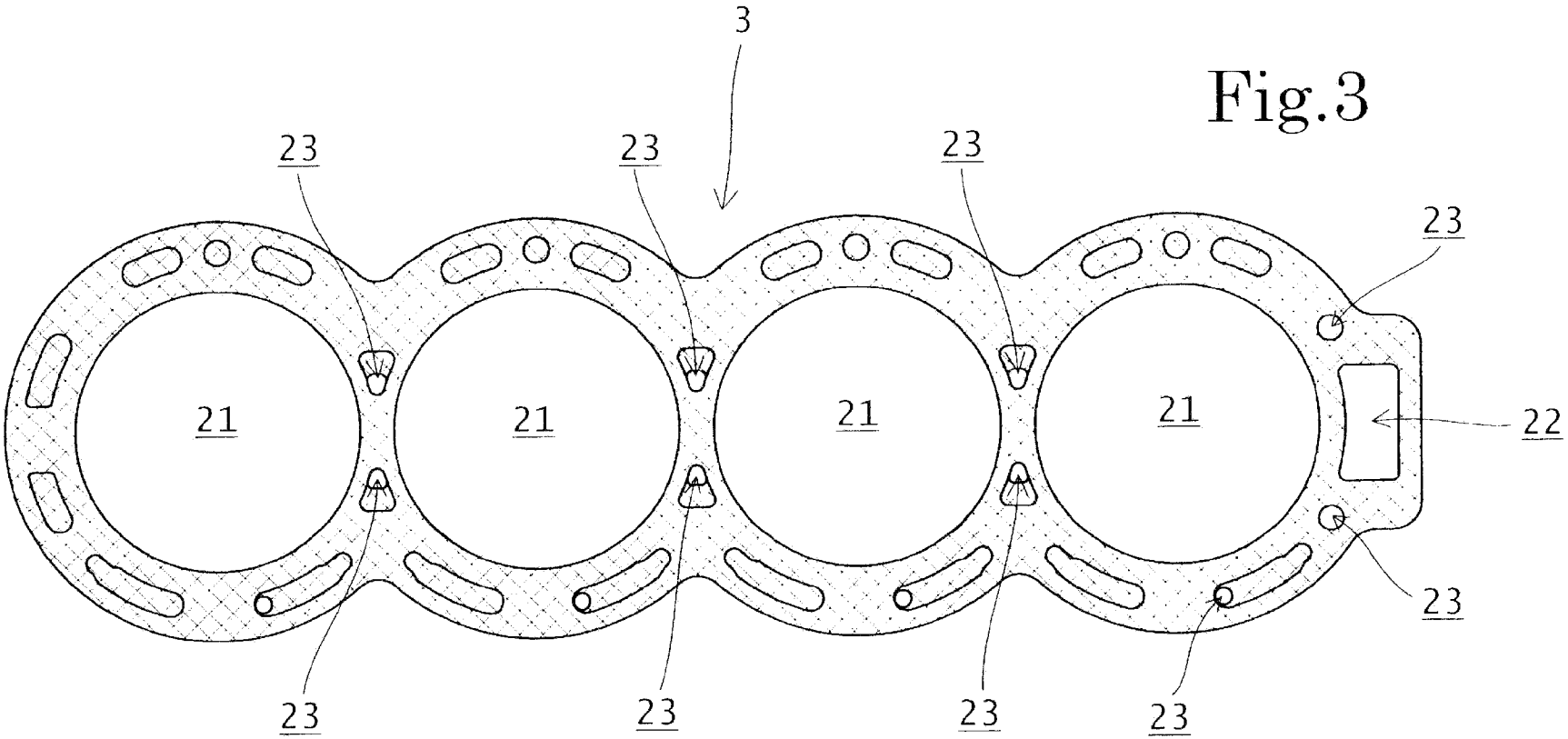
FIG. 3 is a top view of a gasket.

The gasket 3 held between the cylinder block 1 and the cylinder head 2 is a thin plate covering joining surfaces is of the cylinder block 1, and most part of the open upper end of the cylinder block water jacket 15. As shown in FIG. 3, the gasket 3 is provided with a rectangular connecting opening 22 corresponding to a space including a second end part 15*c* of the cylinder block water jacket 15 and the bulged space 16, in addition to circular openings 21 corresponding to the cylinder bores 11.

The gasket 3 is provided with a plurality of small pores 23 in parts thereof corresponding to parts of the cylinder block water jacket 15 where the cooling water flows at low velocity, such as parts each between adjacent ones of the cylinder bores 11, and parts on the opposite sides of the bulged space 16 farthest from the cooling water inlet 14.

When the gasket 3 is placed on the joining surface 1S of the cylinder block 1, most parts of the open upper end of the cylinder block water jacket 15 is closed, excluding parts of the open upper end corresponding to the small pores 23, and the space including the second end part 15*c* of the cylinder block water jacket 15 and the bulged space 16 corresponding to the rectangular connecting opening 22. The cooling water can flow from the cylinder block water jacket 15 through the small pores 23 and the connecting opening 22 into a cylinder head water jacket 35 (FIG. 11) formed in the cylinder head 2.

Figure 7:
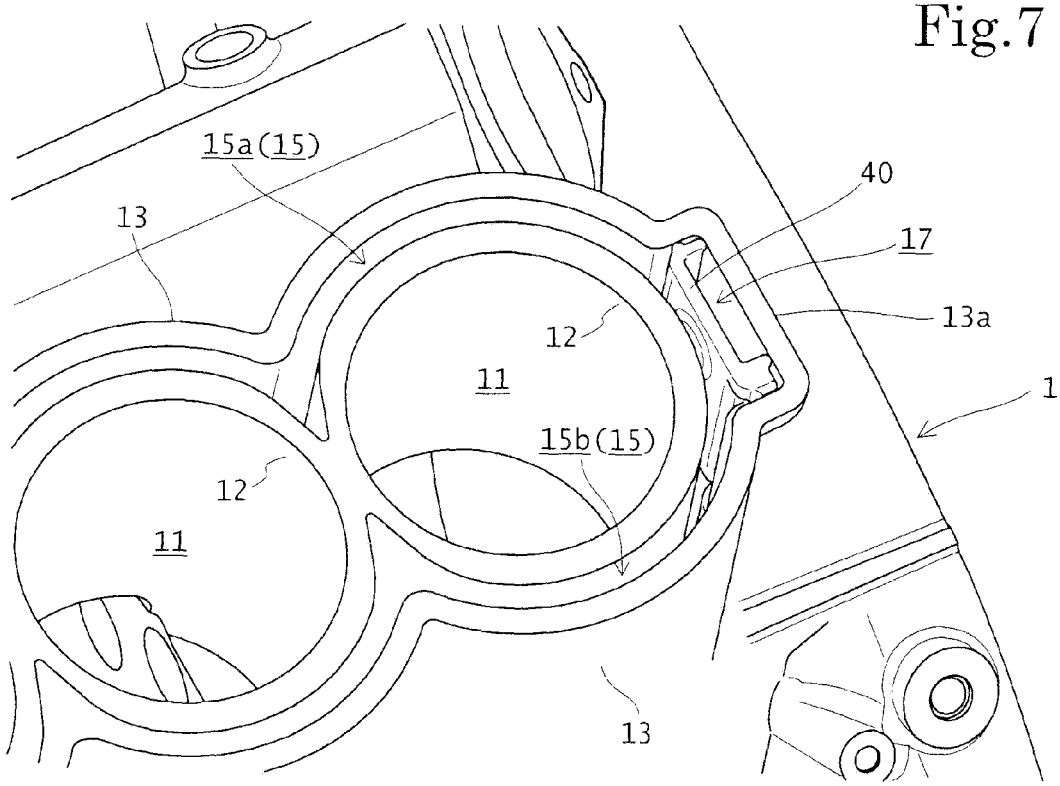
FIG. 7 is a perspective view of an essential part of the cylinder block with the partition member inserted therein.

As shown in FIG. 7, a vertical partition member 40 is inserted into the vertically extending bulged space 16 having a rectangular cross section. The partition member 40 separates the bulged space 16 from the cylinder block water jacket 15 with respect to a horizontal direction to form a lower connecting passage 17.

Figure 4:
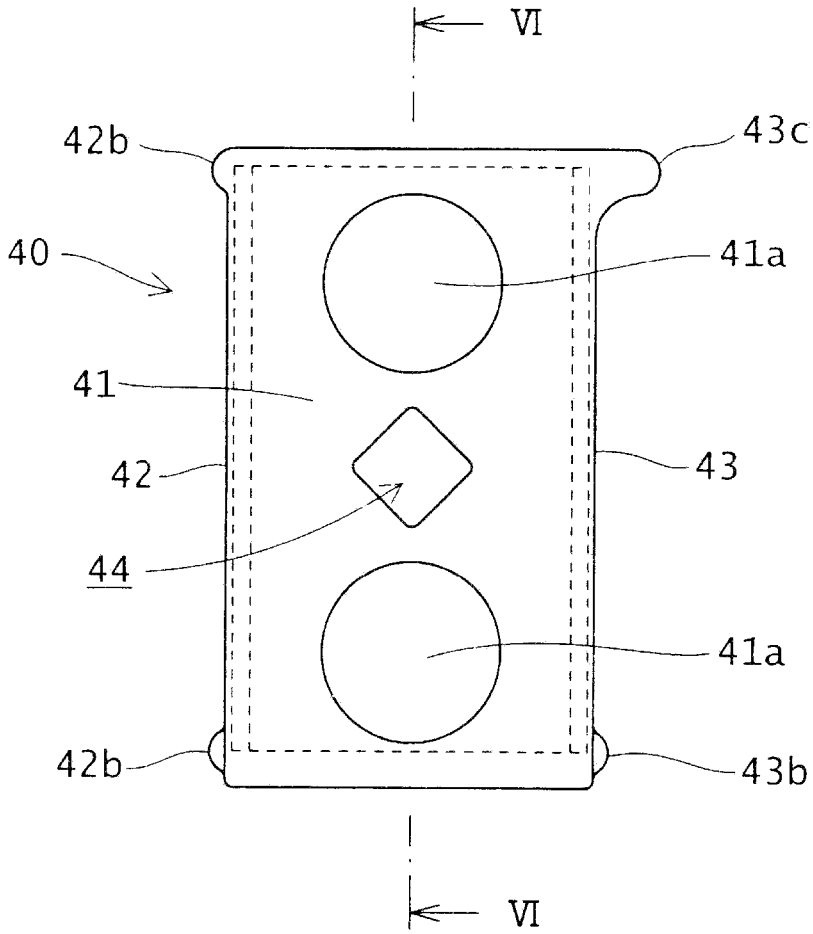
FIG. 4 is a front elevation of a partition member.
Figure 5:
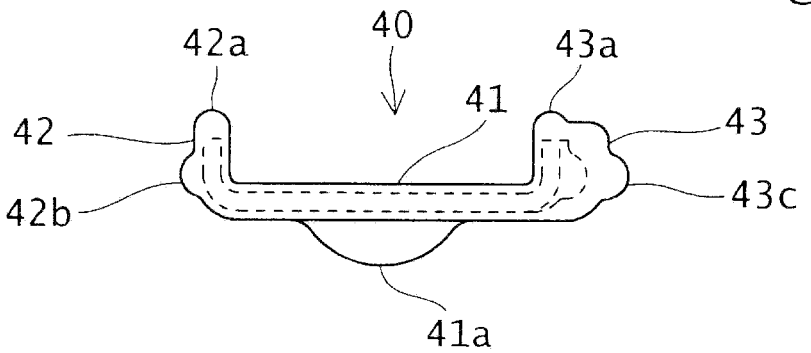
FIG. 5 is a top view of the partition member.
Figure 6:
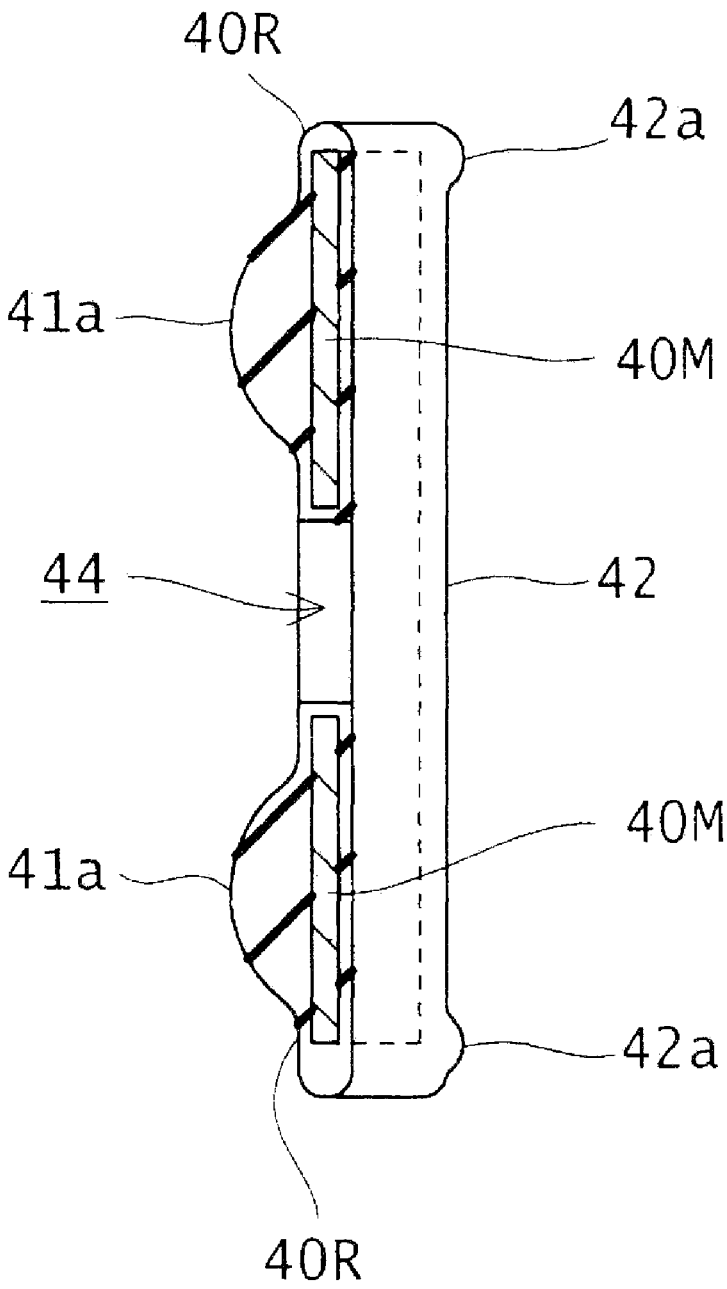
FIG. 6 is a sectional view of the partition member.

Referring to FIGS. 4 to 6, the partition member 40 is formed by coating a metal plate 40M with an elastic coating 40R of an elastic material, such as rubber. The partition member 40 has a vertically elongate, rectangular body 41, a flange-like first side part 42, and a flange-like second side part 43. The flange-like side parts 42 and 43 are formed by bending opposite, long side parts of the rectangular body 41 in the same direction. The rectangular body 41 is provided in its longitudinally middle part with a square opening 44. Parts of the elastic coating 40R respectively on the opposite sides of the square opening 44 and facing a direction opposite the direction in which the flange-like side parts 42 and 43 of the rectangular body 41 extend are protruded to form round protrusions 41*a* having a sectional shape resembling a segment of a circle, and a predetermined height.

Small protrusions 42*a* protrude from the upper and the lower end of the first flange-like side part 42, respectively, in a direction opposite the direction in which the round protrusions 41*a* protrude. Small protrusions 42*b* protrude outward from the upper and the lower end of the first flange-like side part 42.

Small protrusions 43*a* protrude from the upper and the lower end of the second flange-like side part 43, respectively, in a direction opposite the direction in which the round protrusions 41*a* protrude. A small protrusion 43*b* which is the same as the small protrusions 42*b*, and a large protrusion 43*c* of a large height protrude outward from the lower and the upper end, respectively, of the second flange-like side part 43.

Figure 10:
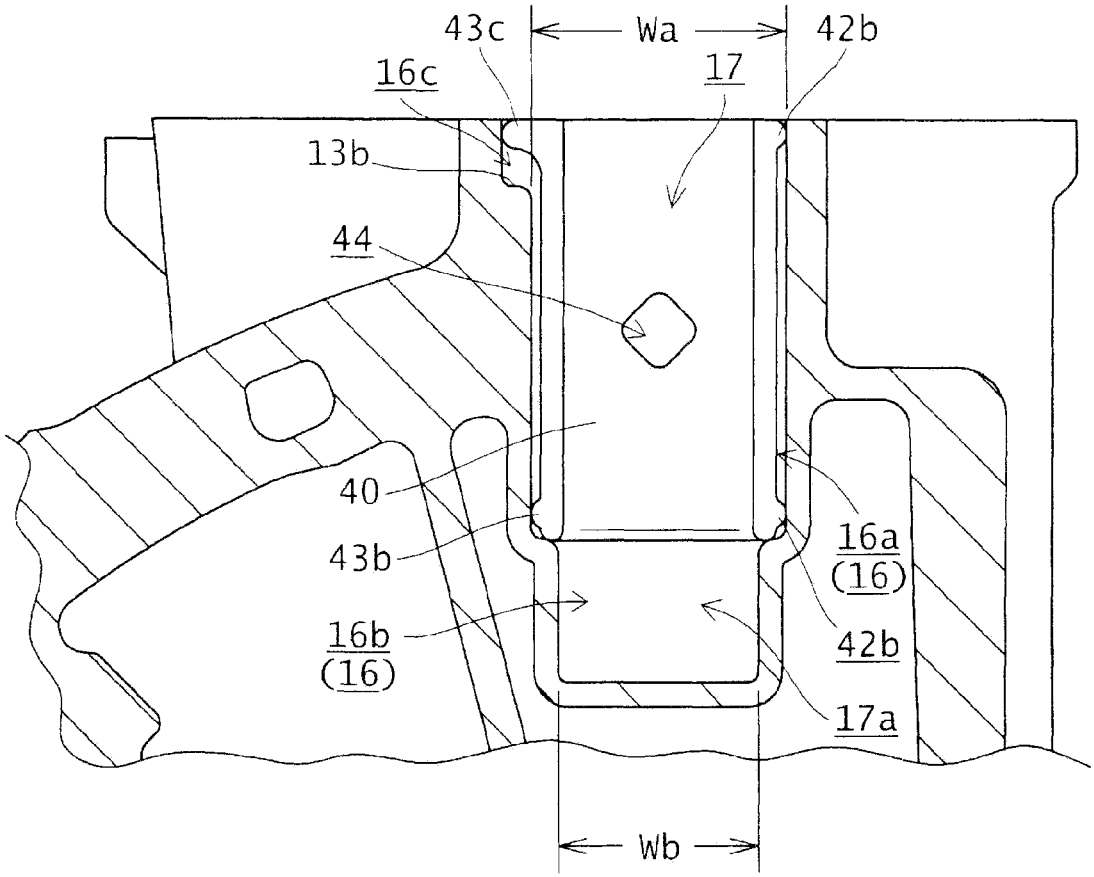
FIG. 10 is a sectional view taken on the line X-X in FIG. 8.

Referring to FIG. 10, the bulged space 16 defined by the bulged part 13*a* of the outer side wall 13 of the cylinder block 1 has a wide upper section 16*a* of a width $W_a$ approximately equal to the distance between the opposite small protrusions 42*b* and 43*b* of the partition member 40, and a narrow lower section 16*b* of a width $W_b$ smaller than the width $W_a$. The wide upper section 16*a* has a depth equal to the length or height of the partition member 40. A step is formed between the wide upper section 16*a* and the narrow lower section 16*b*. An upper end part of one of the inside surfaces of the bulged part 13*a* is cut so as to form a recess 16*c* and a step 13*b*.

Figure 8:
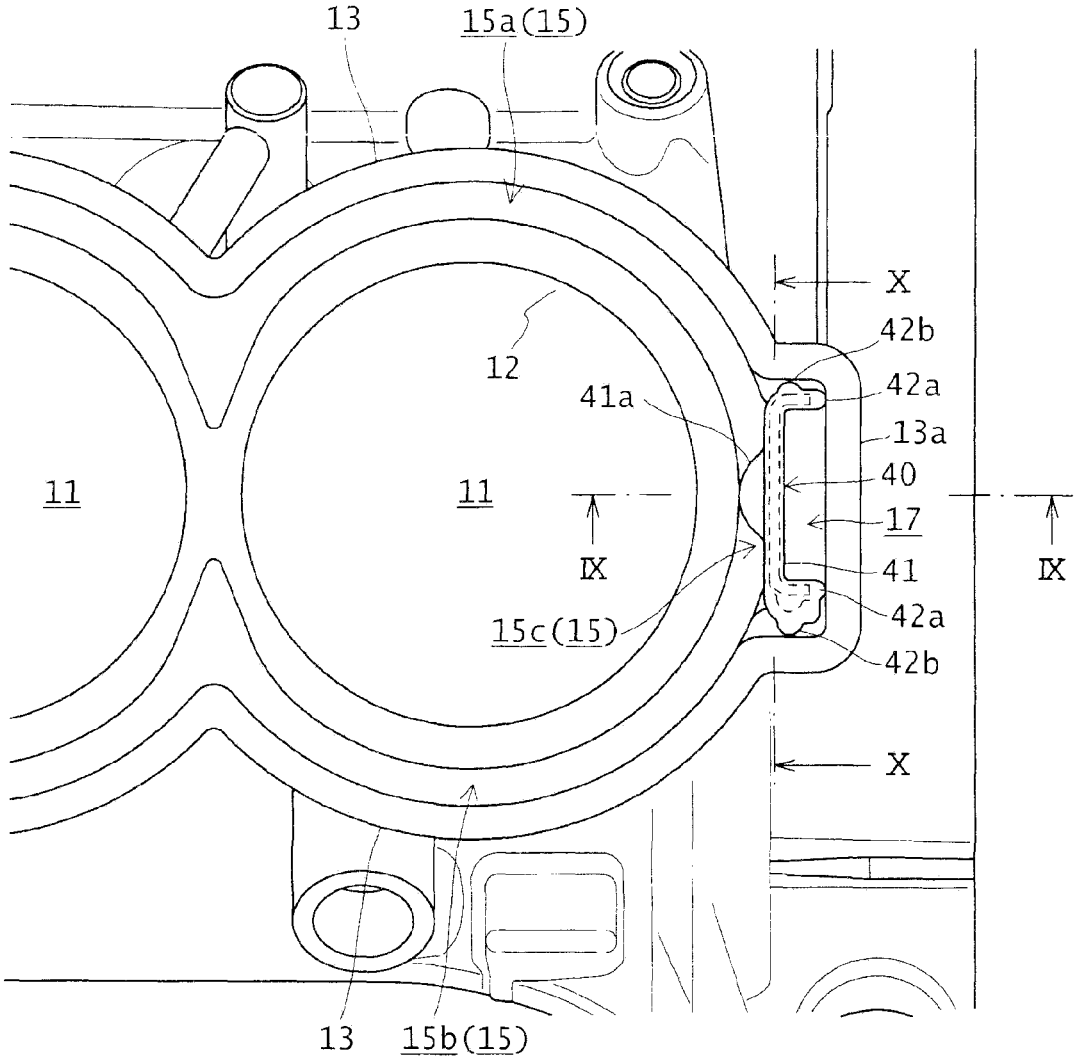
FIG. 8 is a top view of the essential part of the cylinder block.
Figure 9:
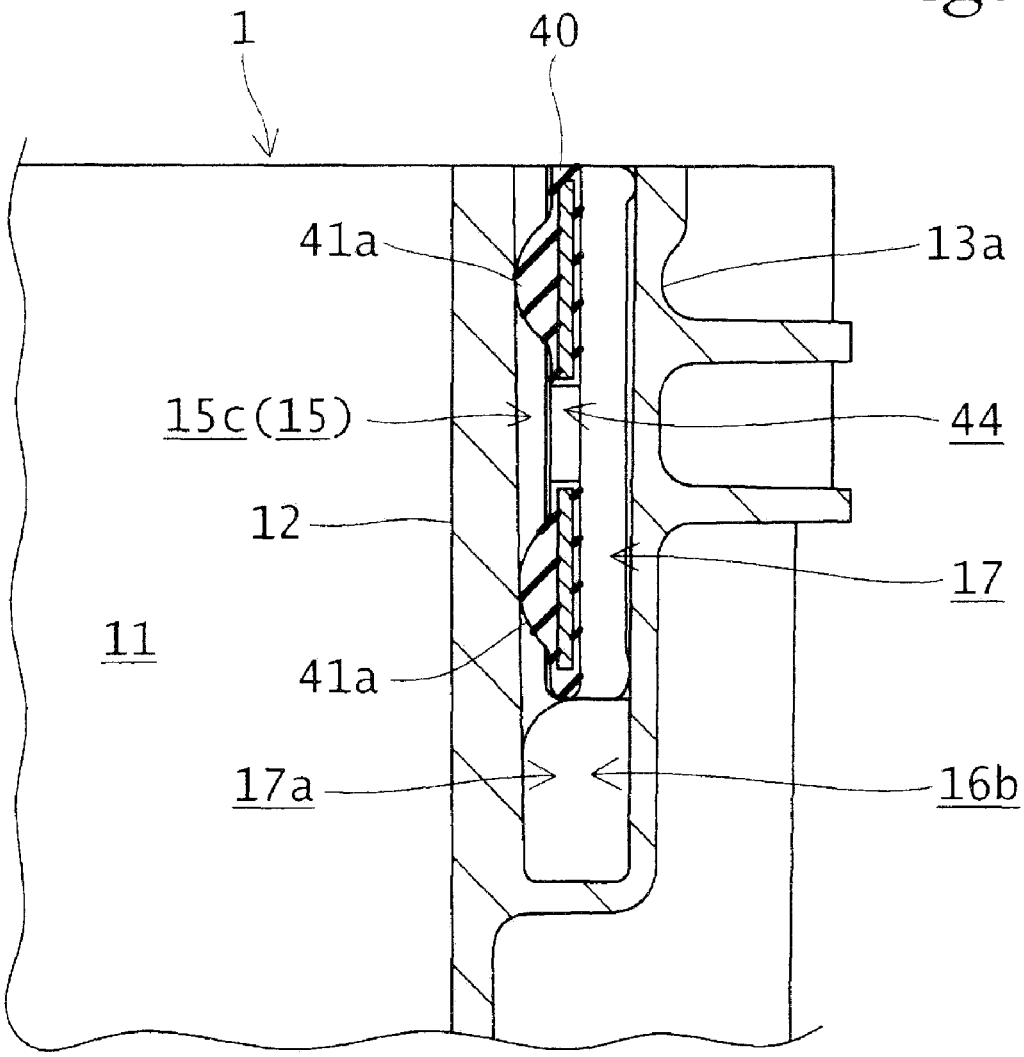
FIG. 9 is a sectional view taken on the line IX-IX in FIG. 8.

The partition member 40 is inserted downward into the bulged space 16 such that the opposite small protrusions 42*b* and 43*b* are on the lower side and the round protrusions 41*a* face the inner side wall 12. In this state, the edges of the flange-like side parts 42 and 43 of the partition member 40 are in contact with the inside surface of the bulged part 13*a* as shown in FIG. 8, and the flange-like side parts 42 and 43 extend along the inside surfaces of side walls defining the wide upper section 16*a*.

The lower end of the partition member 40 is seated on the step between the wide upper section 16*a* and the narrow lower section 16*b* to position the partition member 40 in place in the wide upper section 16*a* so that the upper end of the partition member 40 is flush with the joining surface is of the cylinder block 1.

The partition member 40 extends between the opposite side walls of the bulged part 13*a* with the opposite lower, small protrusions 42*b* and 43*b* of the partition member 40 in contact with the opposite side walls of the bulged part 13*a*, and the upper small protrusion 42*b* and the large protrusion 43*c* in contact with the opposite side walls of the bulged part 13*a*, respectively. Thus the partition member 40 is positioned with respect to a direction perpendicular to the direction in which the cylinder bores 11 are arranged. The partition member 40 is positioned with respect to the direction in which the cylinder bores 11 are arranged between the inner side wall 12 and a part of the bulged part 13*a* facing the inner side wall 12 with the protrusions 41*a* in contact with the inner side wall 12, and the small protrusions 42*a* and 43*a* in contact with the inside surface of the wall of the bulged part 13*a* facing the inner side wall 12.

When the partition member 40 is thus correctly inserted in the bulged space 16, the large protrusion 43*c* is received in the recess 16*c* as shown in FIG. 10. When the partition member 40 is inserted incorrectly into the bulged space 16 facing the reverse direction or upside down, the large protrusion 43*c* of the partition member 40 obstruct the insertion of the partition member 40 into the bulged space 16 to prevent the wrong insertion of the partition member 40 in the bulged space 16.

The partition member 40 correctly inserted into the bulged space 16 isolates the lower connecting passage 17 from the cylinder block water jacket 15. The lower end of the lower connecting passage 17 connects to the narrow lower section 16*b*. The narrow lower section 16*b* not isolated from the cylinder block water jacket 15 by the partition member 40 opens into a lower part of the cylinder block water jacket 15; that is, the lower part of the lower connecting passage 17 communicates with a lower part of the cylinder block water jacket 15 by way of the narrow lower section 16*b*.

When the gasket 3 is placed on the joining surface is of the cylinder block 1 after inserting the partition member 40 into the bulged space 16 defined by the bulged part 13*a*, the rectangular connecting opening 22 of the gasket 3 coincides with the space including the second end part 15*c* of the cylinder block water jacket 15 and the lower connecting passage 17. When the cylinder head 2 is joined to the cylinder block 1, the second end part 15*c* of the cylinder block water jacket 15 and the lower connecting passage 17 communicate with the cylinder head water jacket 35 by way of the rectangular connecting opening 22 of the gasket 3.

The cylinder head 2 is provided in its joining surface to be joined to the joining surface is of the cylinder block 1 with a rectangular inlet of a shape which is substantially the same as the rectangular connecting opening 22 and coinciding with the rectangular connecting opening 22.

Figure 11:
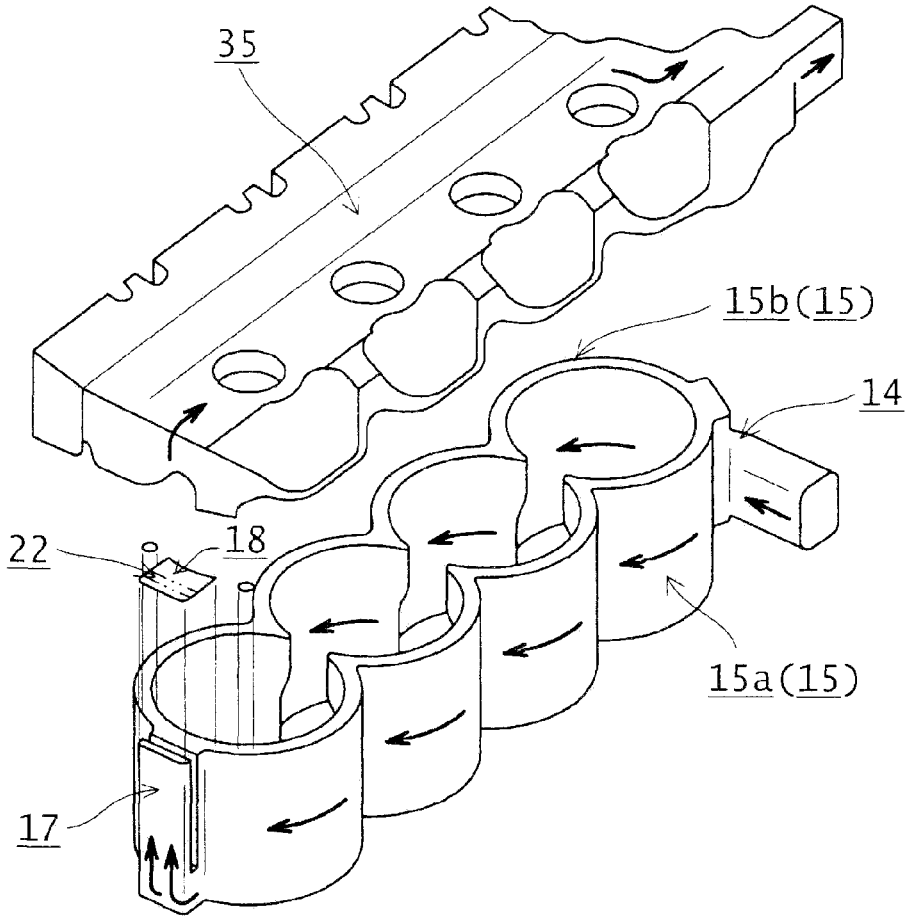
FIG. 11 is a perspective view showing the cylinder block water jacket, a rectangular opening formed in the gasket, and a cylinder head water jacket.
Figure 12:
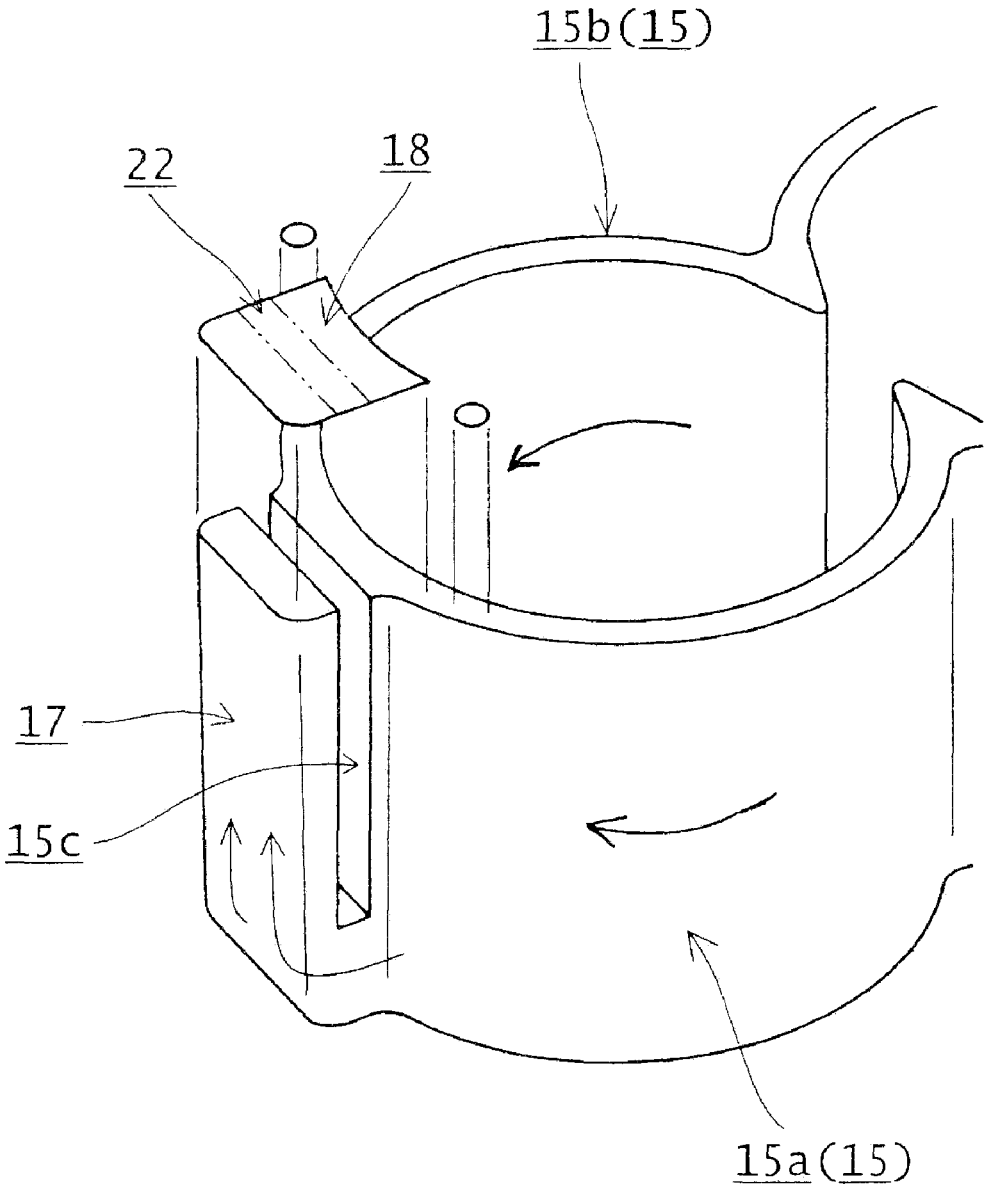
FIG. 12 is an enlarged perspective view of a part of FIG. 11.

FIG. 11 shows cooling water passages including the cylinder block water jacket 15, connecting openings including the rectangular connecting opening 22 of the gasket 3, and the cylinder head water jacket 35, and FIG. 12 is an enlarged view of a part of FIG. 11.

Cooling water that has flowed into the cylinder block water jacket 15 through the cooling water inlet 14 at the first end of the cylinder block water jacket 15 flows in two cooling water streams through the two side passages 15*a* and 15*b* of the cylinder block water jacket 15, and the two cooling water streams meet in the second end part 15*c* of the cylinder block water jacket 15.

Referring to FIG. 12, the cooling water that has flowed through an upper part of the cylinder block water jacket 15 and flowed into the second end part 15*c* can smoothly flow into the cylinder head water jacket 35 through the rectangular connecting opening 22 of the gasket 3, and an upper connecting opening 18 surrounded by the partition member 40.

The cooling water that has flowed through a lower part of the cylinder block water jacket 15 and flowed into the second end part 15*c* flows into the lower connecting passage 17 defined by the partition member 40 through a lower opening 17*a* (FIGS. 9 and 10) opening into a lower part of the cylinder block water jacket 15, flows up through the lower connecting passage 17, and flows into the cylinder head water jacket 35 through the rectangular connecting opening 22 of the gasket 3.

In the conventional water-jacket structure, the flow of the cooling water that has flowed through an upper part of the cylinder block water jacket obstructs the upward flow of the cooling water that has flowed through a lower part of the cylinder block water jacket to cause the cooling water to stagnate in the lower part of the cylinder block water jacket. In the water-jacket structure in this embodiment, the cooling water that has flowed through the lower part of the cylinder block water jacket 15 can smoothly flow into the lower connecting passage 17 through the lower opening 17*a* opening into the lower part of the cylinder block water jacket 15, and can smoothly flow through the lower connecting passage 17 into the cylinder head water jacket 35.

Thus the cooling water can be made to flow smoothly from the cylinder block water jacket 15 into the cylinder head water jacket 35 and the cooling ability can be improved by the simple water-jacket structure, in which the bulged part 13 defining the bulged space 16 is formed in the second end part of the outer side wall 13 of the cylinder block 1, and the partition member 40 is inserted in the bulged space 16, without using a spacer that reduces the volume of a space in which the cooling water flows.

Since the partition member 40 is provided with the square opening 44 in its middle part, the cooling water that has flowed through a middle part between the upper and the lower part of the cylinder block water jacket 15 can smoothly flow through the square opening 44 into the lower connecting passage 17 and can smoothly flow upward through the lower connecting passage 17 into the cylinder head water jacket 35 without being obstructed by the cooling water that has flowed through the upper part of the cylinder block water jacket 15 and without being caused to stagnate. Consequently, the cooling ability can be improved.

The cooling water inlet 14 is formed at the first end of the cylinder block water jacket 15, and the upper connecting opening 18 and the lower connecting passage 17 are formed at the second end of the cylinder block water jacket 15, and hence the respective lengths of the two side passages 15*a* and 15*b* on the opposite sides of the row of the cylinder bores 11 are substantially equal to each other. Therefore, the flows and velocities of the cooling water in the two side passages 15*a* and 15*b* are substantially equal to each other, and hence the cylinder bores 11 can be uniformly and efficiently cooled by the cooling water flowing through the two side passages 15*a* and 15*b* on the opposite side of the row of the cylinder bores 11.

Since the partition member 40 and the cylinder block 1 are separate members, the lower connecting passage 17 and the square opening 44 can be easily formed. Since the separate partition member 40 is provided with the round protrusions 41*a* in contact with the inner side wall 12, the partition member 40 can be easily positioned and can be securely held in the bulged space 16.

The partition member 40 is formed by covering the processed metal plate 40M with the elastic coating 40R of an elastic material, such as rubber. The elastic coating 40R absorbs shocks exerted on the partition member 40 by the cylinder block 1 due to the vibration of the internal combustion engine E. Consequently, the wear of the partition member 40 and noise generation by the partition member 40 can be prevented, and the formation of gaps due to the difference in thermal expansion between the metal plate 40M of the partition member 40 and the cylinder block 1 can be prevented.

Figure 13:
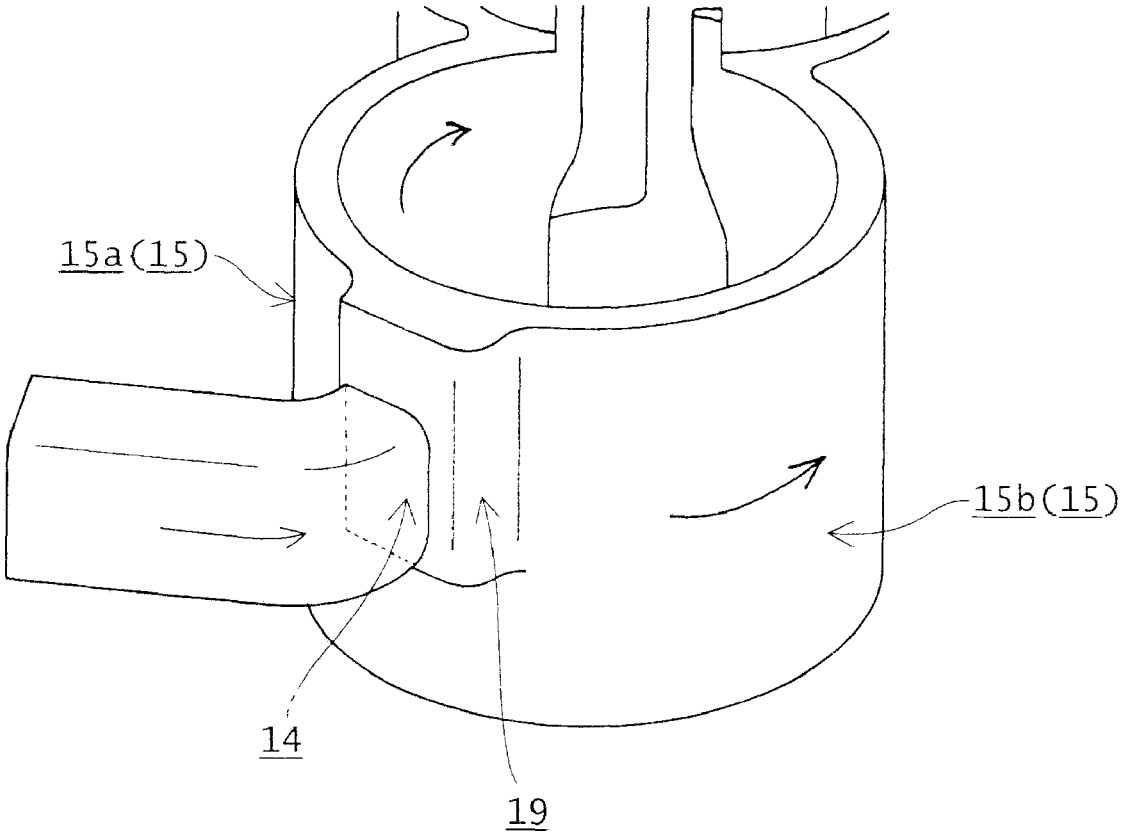
FIG. 13 is an enlarged perspective view of a cooling water inlet shown in FIG. 11.

As shown in FIG. 13, the cooling water inlet 14 through which the cooling water flows into the cylinder block water jacket 15 opens in a bulged space 19 formed by slightly bulging out a part of the first end of the cylinder block water jacket 15. The bulged space 19 extends between the upper end of the first end of the cylinder block water jacket 15 and a middle part of the first end of the cylinder block water jacket 15, at a middle height where the cooling water inlet 14 is formed, and does not extend in a lower part of the first end of the cylinder block water jacket 15.

In some cases, the cooling water that has flowed though the cooling water inlet 14 into the cylinder block water jacket 15 would stagnate in a lower part of the bulged space 19 if the bulged space 19 were formed to extend to the bottom of the first end of the cylinder block water jacket 15. Since the bulged space 19 extends between the upper end and the middle part of the first end of the cylinder block water jacket 15, the cooling water will not stagnate, can flow smoothly and hence a high cooling ability can be maintained.

Although the water-jacket structure in the preferred embodiment has been described as applied to the V-type 8-cylinder internal combustion engine having the two banks having four cylinders each, the present invention is applicable to a water-jacket structure forming a cylinder block water jacket surrounding a single cylinder bore and having one end provided with a cooling water inlet, and the other end opposite the one end provided with a bulged part and a lower connecting passage.

The two round protrusions 41*a* of the partition member 40 are in point contact with the inner side wall 12. Therefore, the partition member 40 can be easily inserted into the bulged space 16 defined by the bulged part 13*a* of the cylinder block 1. The partition member 40 may be provided with ribs that come into line contact with the inner side wall 12 instead of the round protrusions.

The partition member 40 extends to the middle part of the bulged space 16 and does not extend to the bottom of the bulged space 16, and the lower opening 17*a* of the lower connecting passage 17 is formed below the partition member 40 in the foregoing embodiment. A partition member provided with a recess or cutout in its lower end part may be inserted in the bulged space 16 so as to reach the bottom of the bulged space 16 to use the cutout as a lower opening for the lower connecting passage 17.

The partition member may be provided with an opening which functions as the lower connecting passage 17.

The upper connecting opening 18 is formed in the top surface of the cylinder block water jacket 15 in the water-jacket structure in the preferred embodiment. The cylinder block water jacket 15 may be provided with an upper connecting passage having an upper opening that opens into an upper side surface of the cylinder block water jacket 15, bulging out like the lower connecting passage 17, and extending upward from the upper opening to the cylinder head water jacket 35.

Although the rectangular body 41 of the partition member 40 is provided with the square opening 44 in its middle part, the rectangular body 41 may be provided with an opening of a shape other than a square shape.

Although the invention has been described as applied to the V-type 8-cylinder internal combustion engine E, the present invention is applicable also to V-type 10-cylinder internal combustion engines and in-line multicylinder internal combustion engines.

What is claimed is:

1. A water-jacket structure for a water-cooled internal combustion engine, comprising:

a cylinder block having at least one cylinder bore and a cylinder block water jacket surrounding the cylinder bore; and a cylinder head joined to an upper surface of the cylinder block and having a cylinder head water jacket, a cooling water passage being formed to cause cooling water to flow from the cylinder block water jacket into the cylinder head water jacket; wherein:

a gasket is interposed between the cylinder block and the cylinder head, said gasket being formed with an upper connecting opening which opens at an upper part of the cylinder block water jacket and connects to the cylinder head water jacket, the cylinder block has an outer side wall of the cylinder block water jacket, the outer side wall partly bulging outward to form a bulging part defining a bulged space therein, the bulged space is separated by a partition member from the cylinder block water jacket to define in the bulged space a lower connecting passage which opens into a lower part of the cylinder block water jacket and extends upward from the lower part of the cylinder block water jacket in parallel disposition with the cylinder block water jacket, and the cylinder block water jacket and the lower connecting passage are in communication with said upper connecting opening thereabove and with the cylinder head water jacket.

2. The water-jacket structure for a water-cooled internal combustion engine, according to claim 1, wherein the cylinder block is provided with a plurality of cylinder bores arranged in a row, a cooling water inlet to the cylinder block water jacket is formed in one of opposite ends with respect to a direction in which the cylinder bores are arranged, of the cylinder block, the cooling water flows though the cooling water inlet into the cylinder block water jacket, and the upper connecting opening and the lower connecting passage are formed in the other end of the cylinder block.

3. The water-jacket structure for a water-cooled internal combustion engine, according to claim 1, wherein the partition member is provided with an opening in a middle part thereof in a direction along the axis of the cylinder bore, the cylinder block water jacket and the lower connecting passage being in communication with each other via the through opening.

4. The water-jacket structure for a water-cooled internal combustion engine, according to claim 1, wherein the partition member has a substantially rectangular cross section with opposite, flange-like side parts projecting in a direction and protrusion formed on a surface of the rectangular body opposite the flange-like side parts, and wherein the partition member is inserted in said bulged space with the flange-like side parts disposed in contact with inside surfaces of the bulged space and with said protrusions in contact with an inner side wall defining the cylinder bore, whereby said lower connecting passage is formed between the partition member and an opposite inner wall of the bulging part.

5. The water-jacket structure for a water-cooled internal combustion engine, according to claim 4, wherein the bulged space includes a narrowed lower section having a smaller width between the opposite inside surfaces of the bulging part than a width of the partition member, the narrowed lower section defining a step between itself and the rest of the bulged space, and the partition member is seated on the step to provide a space for the lower connecting passage in the narrowed lower section.

* * * * *